United States Patent [19]

Nemschoff

[11] Patent Number: 4,488,755

[45] Date of Patent: Dec. 18, 1984

[54] CHAIR WITH REVERSIBLE SEAT AND BACK CUSHIONS

[75] Inventor: Leonard M. Nemschoff, Sheboygan, Wis.

[73] Assignee: Nemschoff Chairs, Inc., Sheboygan, Wis.

[21] Appl. No.: 419,804

[22] Filed: Sep. 20, 1982

[51] Int. Cl.[3] ..... A47C 7/00

[52] U.S. Cl. ..... 297/443; 297/444; 297/283

[58] Field of Search ..... 297/440, 443, 444, 283

[56] References Cited

U.S. PATENT DOCUMENTS

| | | | |
|---|---|---|---|
| 2,668,584 | 2/1954 | Greitzer | 297/444 |
| 2,853,125 | 9/1958 | Starke | 297/283 |
| 2,955,646 | 10/1960 | Briggs | 297/444 |
| 3,173,723 | 3/1965 | Hoven et al. | 297/DIG. 2 |
| 3,194,601 | 7/1965 | Hoven et al. | 297/336 |
| 4,395,071 | 7/1983 | Laird | 297/443 |

*Primary Examiner*—Francis K. Zugel
*Attorney, Agent, or Firm*—James E. Nilles

[57] ABSTRACT

A seating unit such as a chair or sofa comprises opposite, upright, rigidly connected side members, a reversible seat cushion having a back face and a reversible back cushion having a bottom face. A beam extending laterally between the side members has its ends rigidly connected to them and supports rod-like forwardly projecting cantilevered legs for the seat cushion and similar upwardly projecting legs for the back cushion. The legs for each cushion are lengthwise slidably received in bores in an internal frame of the cushion that extend inwardly from said face of the cushion. Deep inside each bore is a detent device which is engaged by full installation of the cushion on its legs and which releasably locks the cushion against outward movement on its legs. Each detent device is released by inserting a long, slender splint-like tool into the bore.

6 Claims, 11 Drawing Figures

CHAIR WITH REVERSIBLE SEAT AND BACK CUSHIONS

FIELD OF THE INVENTION

This invention relates to seating units such as chairs and sofas and is more particularly concerned with seating units intended for hard usage environments and characterized by reversible seat and back cushions.

BACKGROUND OF THE PRIOR ART

In recent years attention has been given to chairs and multiple-seat units that are particularly intended for environments in which they may be given very rough treatment. College and university dormitories and lounges have particular need for such sturdy seating units, but there is also a need for them in hotel and motel rooms and lobbies, in institutions for emotionally disturbed or mentally impaired persons, and in air terminal waiting areas and similar public places. They may also be desired for some private domestic uses, as for furnishing household rumpus rooms.

Such a seating unit should have upholstered seat and back cushions, for the sake of comfort and attractive appearance, but it must nevertheless be capable of sustaining hard use—and even abuse and vandalism—without requiring repairs that are costly. To this end, seating units of the type here under consideration are made with very sturdy supporting frames and with reversible cushions. When the seat cushion of such a chair becomes dirty or worn, it is removed and reinstalled upside down, to double its effective life. The back cushion is similarly reversible front-to-rear. The covering on each cushion may be formed to be readily removable so that when both sides of a cushion have become unpresentable, it can be removed from the supporting frame and a new covering can be quickly installed on it.

One commercially available chair intended for hard-usage situations has its reversible cushions supported by L-shaped rails or ridges on opposite sides of its supporting frame, each projecting inwardly from an upright side frame member. Each rail has a forwardly extending portion for the seat cushion and an upwardly extending portion for the back cushion. A sturdy inner frame for each cushion has grooves in its opposite sides that receive the rail portions with which the cushion cooperates. Each of the cushions is freely slidable through some distance away from its normal position, unitl it engages a releasable stop that confines it against complete removal from the supporting frame. For reversal of the cushions, the back cushion is first slid upward along its rail portions sufficiently to permit access to a stop release actuator on its bottom face. Use of a special tool on the actuator disables the stop and allows the back cushion to be completely removed from the main frame. The seat cushion is then removed forward from its normal position to permit access to a stop release actuator on its rear face, and the actuating tool is similarly used to allow the seat cushion to be drawn all the way forward off of the main frame. The special tool must again be used on each cushion when it is reinstalled on the main frame.

In order to allow the rails on the main frame to engage in the grooves in each cushion frame without interference from the covering on the cushion, the covering has elongated edge portions extending along each groove, spaced to opposite sides of the groove. These edge portions are detachably secured to the cushion frame by means of Velcro or the like.

Although possessing obvious merits and advantages, this prior seating unit also has certain disadvantages and deficiencies, some of which are not immediately apparent but are nevertheless of major significance to those concerned with the purpose and maintenance of furniture of the type under consideration. The fact that each of the cushions is freely movable through a perceptible distance to and from its normal position offers a certain amount of temptation for attempts at unauthorized complete removal of the cushions wherein brute force may be employed in an effort to defeat the stops that are normally released by the special tool. The nature of the rail connections between the main frame and the cushions gives rise to other disadvantages. The arrangement is not well suited for embodiment in multiple-seat units because there is no way to support the side of a cushion that is not adjacent to an upright frame member. The rail connections create the need for slots in the side portions of each cushion cover and thus tend to increase the cost of cutting and sewing the covers. To conceal these slots in the cushion covers, the upright side frame members can have no openings in them, and the seating unit therefore tends to have a somewhat blocky and heavy appearance. In addition, the edge portions of the seat cushion cover that extend along the slots in its frame can be peeled away rather easily and inconspicuously by an occupant of the chair, thus opening the cover for insertion of small packets of contraband or wads of chewing gum or other nuisance articles.

SUMMARY OF THE INVENTION

The general object of the present invention is to provide a sturdy and attractive but inexpensive seat unit—which can be either a chair or a multiple-seat unit—having reversible seat and back cushions which are readily removable with a simple special tool but which provide no readily perceptible indication that they are removable from the main frame.

It is also a general object of the invention to provide a structural arrangement for reversible cushion seating units that is equally well suited for embodiment in a chair and in a multiple-seat unit such as a love seat or a sofa.

Another and more specific object of the invention is to provide a reversible-cushion seating unit of the character described wherein the seat and back cushions are releasably locked in their normal positions and wherein all elements of the unit are so arranged that a person unfamiliar with its construction is not likely to realize that its cushions are removable, much less to discover how they are removed.

A further specific object of the invention is to provide an attractive seating unit of the character described, capable of being embodied as either a single seat chair or a multiple-seat unit, wherein sturdiness of the supporting structure is in no wise compromised in favor of removability of the seat and back cushions.

A rather specialized but very important object of the invention is to provide a reversible-cushion seating unit of the character described wherein each of the seat and back cushions has only two inconspicuously small and relatively inaccessible openings that provide for its attachment to supporting structure, so that the covers on the cushions are not likely to serve as hiding places for nuisance articles and the like, but wherein each cushion cover is nevertheless readily removable upon opening of a zipper in it that is normally concealed and is substantially inaccessible to a person seated in the unit.

In this connection it is another object of this invention to provide a seating unit of the character described wherein the side surfaces of the seat and back cushion covers have no openings or slots that must be concealed by upright side members and wherein the side members can be of open arm design.

Another specific object of the invention is to provide a reversible-cushion seating unit of the character described wherein removal of the seat and back cushions requires the use of a special tool but installation of those cushions onto the supporting frame can be accomplished by merely sliding each of the cushions all the way to its assembled position, at which each cushion automatically locks and from which either of the cushions can be removed and installed without disturbing the other.

In general, these and other objects of the invention that will appear as the description proceeds are achieved in a reversible-cushion seating unit of this invention, which comprises opposite upright side members that are rigidly connected in laterally spaced relation to one another, a seat cushion having a rear face, and a back cushion having a bottom face, each of said cushions having a rigid internal frame. The seating unit of this invention is characterized by a pair of rod-like substantially L-shaped members, each having a forwardly projecting leg for the seat cushion and an upwardly projecting leg for the back cushion; and by a beam extending laterally between said side members and connected to each side member at a rear portion thereof, said beam having a rigid connection to each of the L-shaped members near the junction of its legs whereby the L-shaped members are supported in inwardly spaced relation to the side members and with their like legs parallel to one another. The internal frame of each cushion defines a pair of parallel bores which extend inwardly of the cushion from its said face and in which its legs of the L-shaped members are lengthwise slidably receivable. A preferred embodiment of the seating unit further comprises a pair of detent devices for each cushion that are substantially simultaneously engaged by sliding the cushion fully onto its legs of said L-shaped members and whereby the cushion is releasably confined against displacement along its legs in the direction away from said beam. Each detent device comprises a detent element on a leg of an L-shaped member and a cooperating detent element on the internal frame of a cushion, and one of said detent elements is movable in opposite directions parallel to the length of said beam and is biased in one of those directions for urging an abutment on it into engagement with a cooperating abutment on the other detent element. Preferably said abutments are so arranged that their engagement positively but releasably locks the cushion against displacement along its legs of the L-shaped members in the direction away from the beam. The detent elements on the legs of the L-shaped members are substantially closer to the free ends of the legs than to the beam, and each bore has a widened portion wherein a detent device is accommodated and which extends outwardly from the detent device through said face of the cushion for receiving a long, slender tool whereby said one detent element can be actuated in the other of said opposite directions for disengagement of the cooperating abutments of the detent device.

BRIEF DESCRIPTION OF DRAWINGS

In the accompanying drawings, which depict what is now regarded as a preferred embodiment of the invention.

DETAILED DESCRIPTION OF PREFERRED EMBODIMENTS OF THE INVENTION

Figure 1:
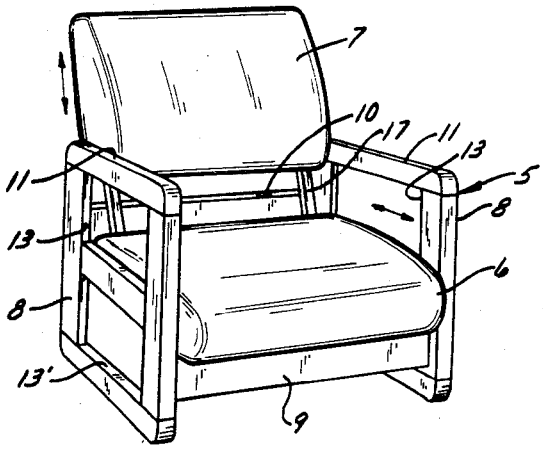
FIG. 1 is a front perspective view of a chair embodying the principles of this invention, with its back cushion partway out of its normal position.
Figure 2:
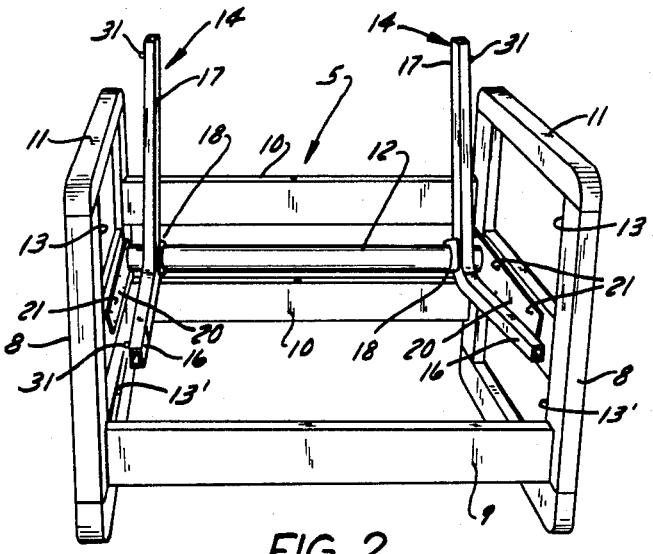
FIG. 2 is a front perspective view of the supporting structure of a chair of this invention, that is, the chair with its seat cushion and back cushion removed.
Figure 3:
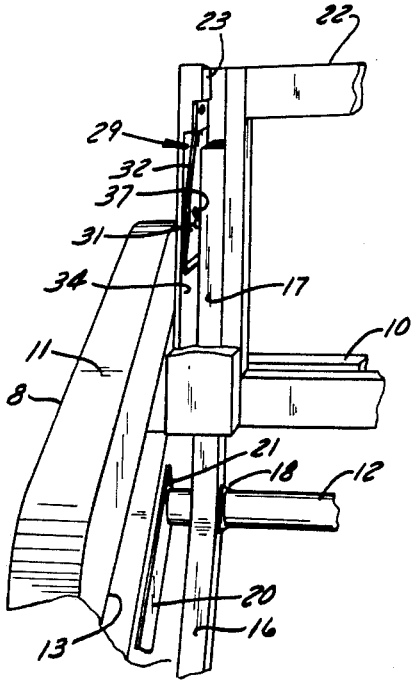
FIG. 3 is a detail perspective view, with portions cut away, showing the internal frame of the back cushion in its relation to the supporting structure when the back cushion is in its position shown in FIG. 1.
Figure 4:
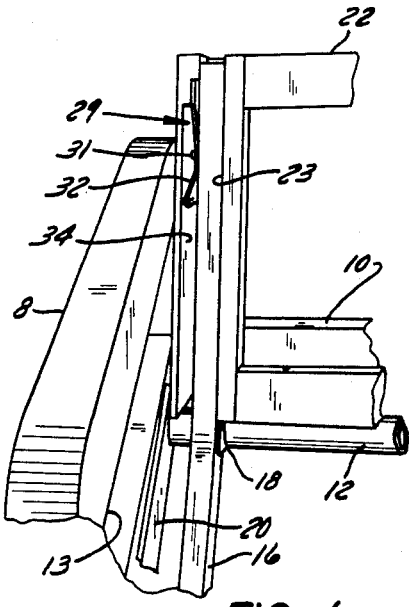
FIG. 4 is a view generally similar to FIG. 3 but showing the internal frame of the back cushion in its normal, fully assembled position on the supporting structure.

A seating unit of this invention, considered as a chair, comprises, in general, a supporting structure or main frame 5, a substantially horizontal seat cushion 6, and an upright back cushion 7. The main frame comprises a pair of upright side members 8 that are rigidly connected and held in laterally spaced relation to one another by sturdy transverse members which are here illustrated as comprising a front crosspiece 9 and two vertically spaced apart rear crosspieces 10.

In this case the side members 8 are shown as being flat relatively thick, and substantially rectangular in outline, and of such height that their upper edge surfaces 11 can serve as armrests of the chair, as will be apparent from FIG. 1. For an attractive appearance the side members 8 can be made of wood, but other materials are obviously suitable, bearing in mind that the side members should desirably be sturdy in themselves and should have very sturdy connections to the transverse members 9 and 10. Because of the manner in which the seat and back cushions 6 and 7 are supported, as explained hereinafter, the side surfaces of those cushions can be visible, and therefore the side members 8 can be open, having—as here shown—horizontally elongated upper and lower rectangular cutouts 13 and 13', or such other cutouts as may be desired for circulation of air and for esthetic reasons.

Figure 7:
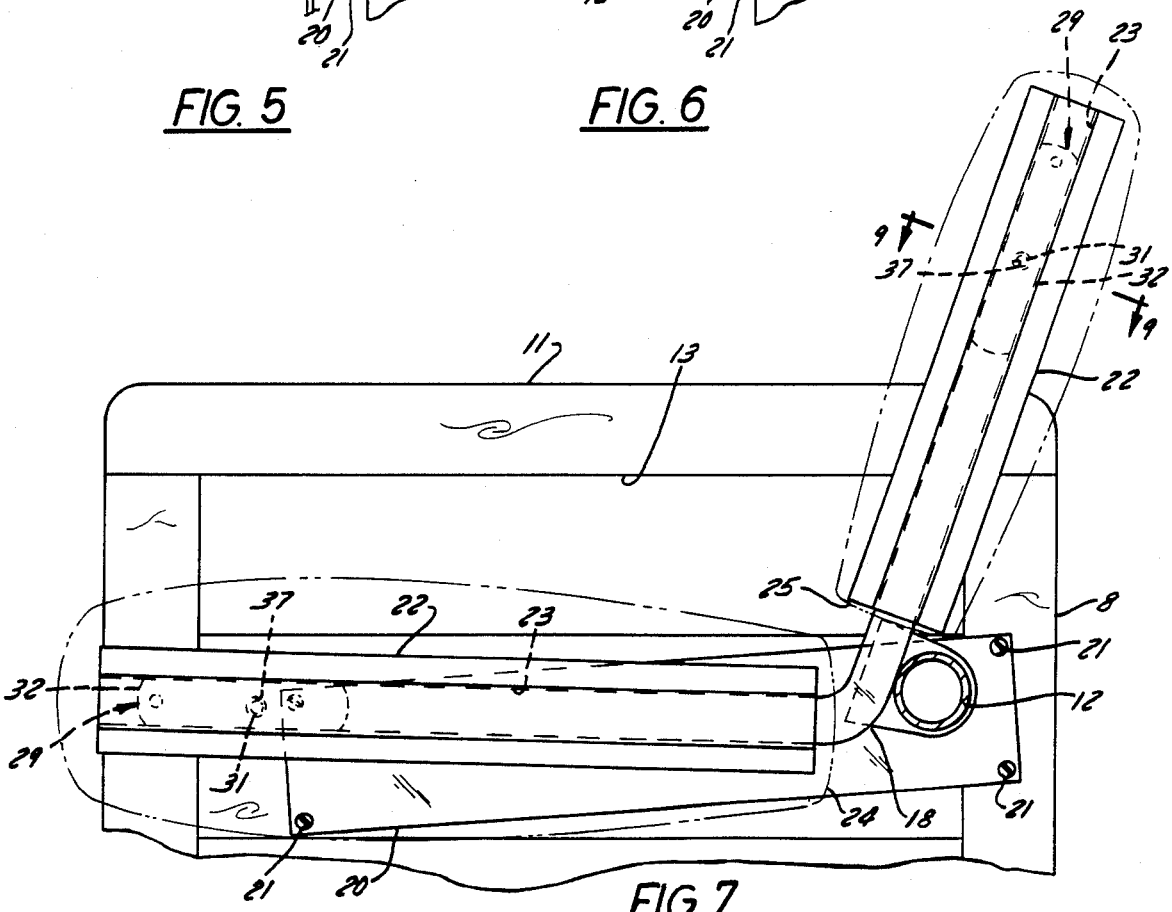
FIG. 7 is a view of the seating unit in section, taken on a vertical plane just inside one of the upright side members and looking sideward towards the other one.

Each of the cushions 6 and 7 is removably secured to the main frame 5 as explained hereinafter, and for reversibility the seat cushion 6 is symmetrical to a substantially horizontal plane while the back cushion 7 is symmetrical to a substantially upright plane, as best seen in FIG. 7. Of course each of the cushions 6 and 7 also has left-to-right symmetry. Conceivably the back cushion 7 could be identical with the seat cushion 6, although at some possible sacrifice of seating comfort or appearance.

The structure that directly supports the cushions 6 and 7 comprises a horizontal beam 12 that extends between the side members 8 and is secured to a rear portion of each of them, together with a pair of generally rod-like L-shaped members 14, each having a forwardly projecting leg 16 for the seat cushion 6 and an upwardly projecting leg 17 for the back cushion. Near the junction of its legs 16 and 17 each of the L-shaped members 14 has a rigid connection 18 to the beam 12. The connections 18 are at such locations along the beam 12 that the L-shaped members 14 are spaced apart by a distance somewhat less than the width of a cushion 6 or 7, and in the case of a chair each of the L-shaped members is near one of the side members 8 but in inwardly spaced relation to it. It will be observed that the legs 16 and 17 of the L-shaped members are substantially fully cantilevered and that the forwardly projecting legs 16 extend parallel to one another as do the upwardly projecting legs 17.

Since the cantilevered legs 16 must support the weight imposed upon the seat cushion 6, it will be understood that the connections 18 must be very sturdy ones, comprising in this case gussets that are welded to the beam 12 and to the L-shaped members 14. Furthermore, each of the L-shaped members 14 is formed from a single length of sturdy square-section tubing that is bent to a relatively large radius at the junction of its legs 16, 17. Although the forwardly projecting legs 16 are substantially rigid, they have some degree of resilience and can therefore flex slightly to absorb abrupt downward loads upon them.

In the case of a chair, the largest forces on the beam 12 are in torsion, and therefore the beam is preferably a circular-section pipe or tube. Each end of the beam 12 is securely welded to the rear end portion of an elongated plate 20 that flatwise overlies the inner surface of an adjacent side member 8 and is secured to it, as by screws 21. Each plate 20 extends forwardly a substantial distance along its side member 8 to provide a long moment arm for supporting the torsion forces upon the beam 12. The beam 12 in its connection to the plates 20 also cooperates with the crosspieces 9 and 10 in providing the connection between the side members 8.

Figure 10:
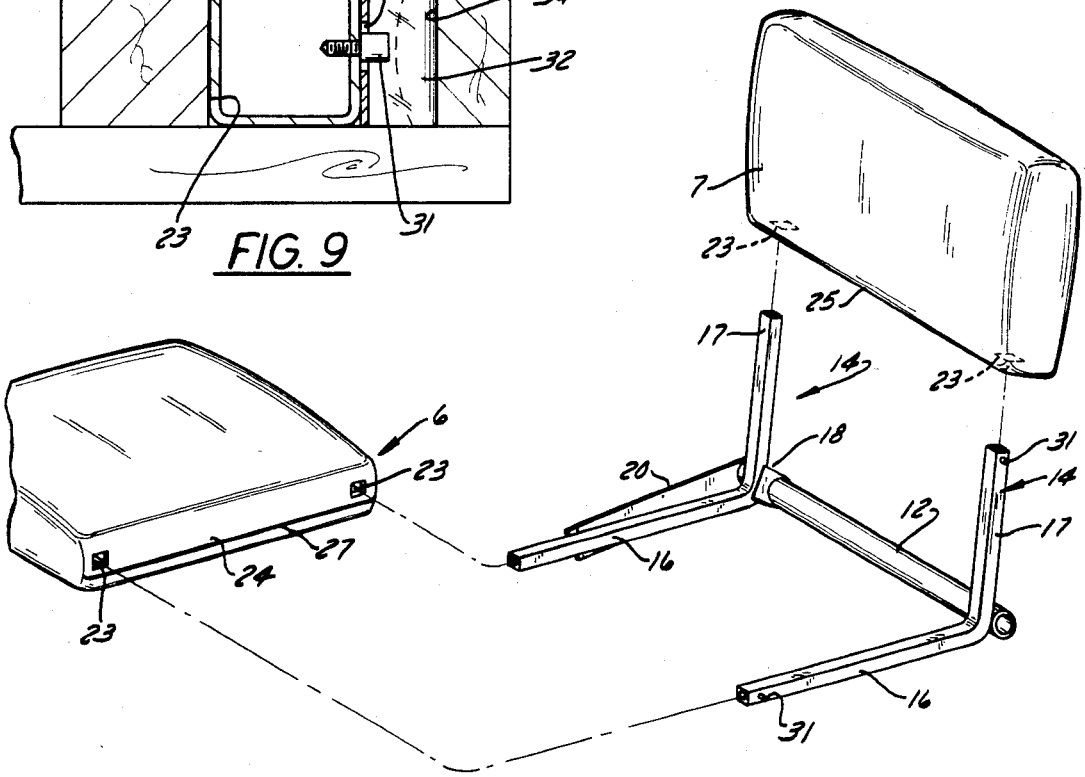
FIG. 10 is a disassembled perspective view of the seat and back cushions in relation to the elements that directly support them.

Each of the cushions 6 and 7 has an internal substantially rectangular frame 22 that is substantially in the plane of symmetry of the cushion. It will be understood that suitable padding overlies the opposite faces of each cushion frame 22 and that a cover of fabric or the like encloses the padding and the frame. Along each of its laterally opposite sides each cushion frame 22 is formed to define a channel-like bore 23 in which one of the legs 16, 17 of an L-shaped member is lengthwise slidably receivable with a close fit. Of course the two bores 23 in each cushion 6, 7 extend parallel to one another and are spaced apart by the same distance as the L-shaped members 14. The bores 23 in the seat cushion 6 open through its cover at a narrow rear face 24 of that cushion, to receive the forwardly projecting legs 16; and, similarly, the two bores 23 in the back cushion 7 open through its cover at its narrow bottom face 25 to receive the upwardly projecting legs 17. It is noteworthy that the two holes in each cushion cover that receive the supporting legs 16 or 17 for the cushion are the only openings in the cover, and that they are very small and are located in a part of the cushion that is normally not visible and is relatively inaccessible. To facilitate changing the cover on each cushion, the cover can have a fly opening 27 (FIG. 10) extending lengthwise along the apertured face 24, 25 of its cushion 6, 7 and closed by a zipper or the like.

As each cushion 6 or 7 is slid along its legs 16 or 17, a detent device 29 for each of its legs, concealed within the cushion, is cammingly actuated; and that device engages when the cushion fully attains its normal position to releasably confine the cushion against displacement from that position. The normal position of each cushion 6, 7 is of course its position in which the cushion is fully engaged with its legs 16 or 17 and its apertured face 24 or 25 is nearest the beam 12. Each detent device 29 could be so arranged (by certain obvious modifications of the structure hereinafter described) that it would merely provide yielding resistance to withdrawal of the cushion from the normal position, but preferably each detent device effects positive but releasable locking of the cushion against movement along its legs 16 or 17.

Each detent device 29 comprises a detent element 31 that is mounted on a leg 16 or 17 and a cooperating detent element 32 that is mounted on the internal cushion frame 22 and is accommodated near the inner end of a widened portion 34 of the bore 23 in which the leg is received, which widened portion extends all the way out to the face 24 or 25 of the cushion 6 or 7.

In general, one of the detent elements of each detent device 29 is movable in opposite directions parallel to the length of the beam 12 and is biased in one of those directions for engagement of an abutment on it with an abutment that comprises the other detent element. Further, said one detent element is so arranged that during movement of the cushion towards its normal position the other detent element cams said one detent element in the other of said opposite directions, to provide for automatic engagement of the abutments.

Figure 5:
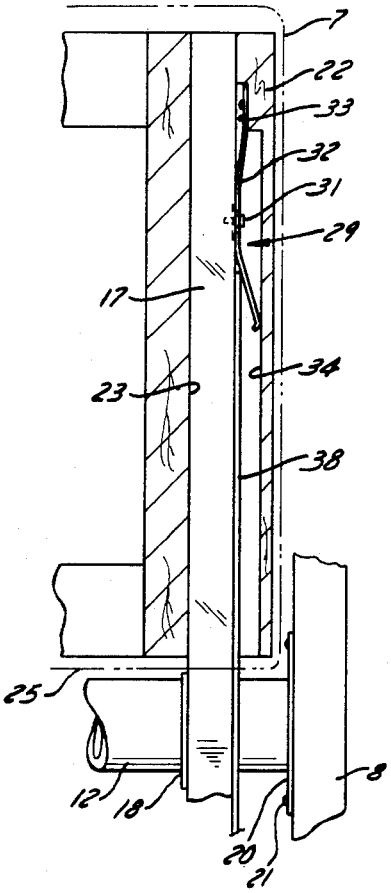
FIG. 5 is a fragmentary view in section taken substantially on the plane of front-to-back symmetry of the back cushion, particularly illustrating details of one detent device, which is shown in its engaged condition.
Figure 6:
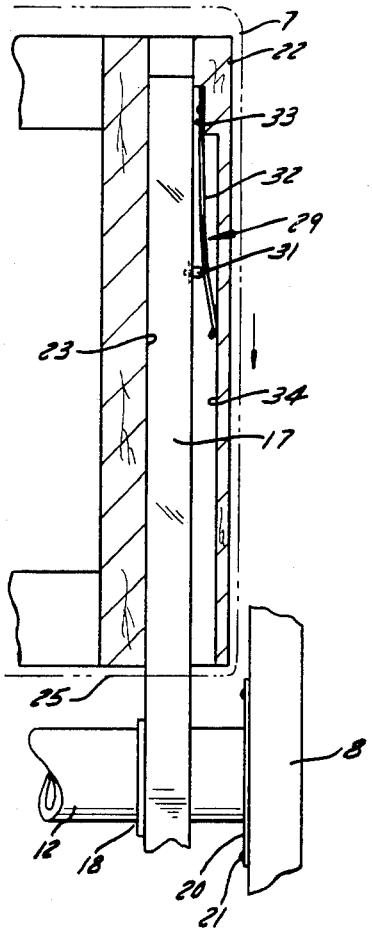
FIG. 6 is a view generally similar to FIG. 5, but showing conditions that exist when the back cushion is partway out of its normal position and the detent device is disengaged.
Figure 8:
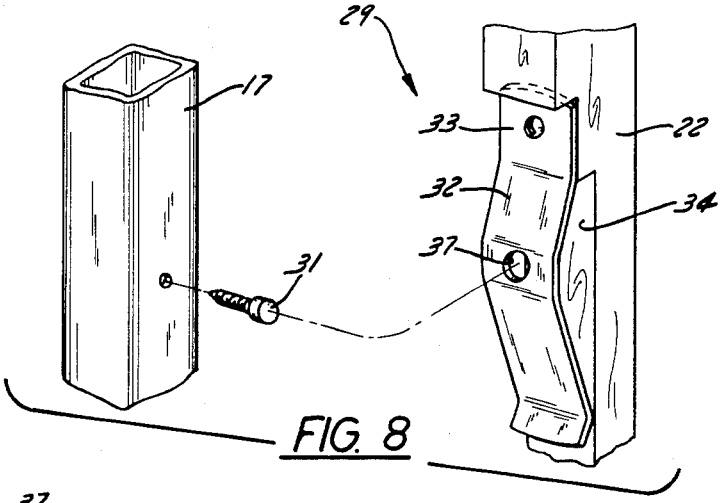
FIG. 8 is a detail exploded perspective view of one of the detent devices.
Figure 9:
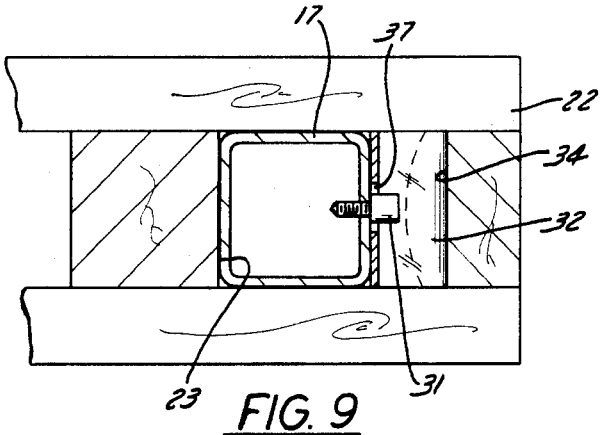
FIG. 9 is a fragmentary view in section taken on the plane of the line 9—9 in FIG. 7.

Specifically, in the particular embodiment of the detent device 29 that is here illustrated, the detent element 31, which provides a relatively fixed abutment, is in the nature of a stud or cap screw (FIGS. 8 and 9) that is secured to the leg 16 or 17 to project from one side of it at a substantial distance from the beam 12. The other detent element 32, as best seen in FIGS. 5, 6 and 8, comprises a bowed leaf spring which has a captive end 33 secured in any suitable manner to the cushion frame 22 and which projects lengthwise outwardly in the widened bore portion 34 with its convex surface facing the adjacent leg 16 or 17. A hole 37 in the bellied intermediate portion of the leaf spring detent element 32 defines the abutment on that element and is of a size to receive the stud-like detent element 31 with a releasable locking engagement. It will be apparent that as a cushion 6 or 7 progresses through the final stages of movement toward its normal position, the stud-like abutment element 31 cammingly engages the inclined free end portion of the spring 32, as shown in FIG. 6, to flex the bellied mid-portion of the spring away from the adjacent leg 16 or 17, so that the stud-like element 31 can enter the hole 37 with a snap action.

A long, slender, splint-like tool 38 is used to release the leaf-spring detent element 32 from its locking engagement with the stud-like detent element 31. As shown in FIG. 5, the tool 38 is inserted lengthwise into the widened portion 34 of the bore 23, and its tip is forced into camming engagement with the inclined free end portion of the spring element 32 to flex the bellied portion of that element laterally away from its engagement with the stud-like element 31. The cooperating detent elements 31, 32 are preferably located so far from the mouth of the bore 23 as to be inaccessible to an ordinary screw driver, and at this location the detent device 5 is so nearly invisible that the nature of its mechanism cannot be readily discovered.

Figure 11:
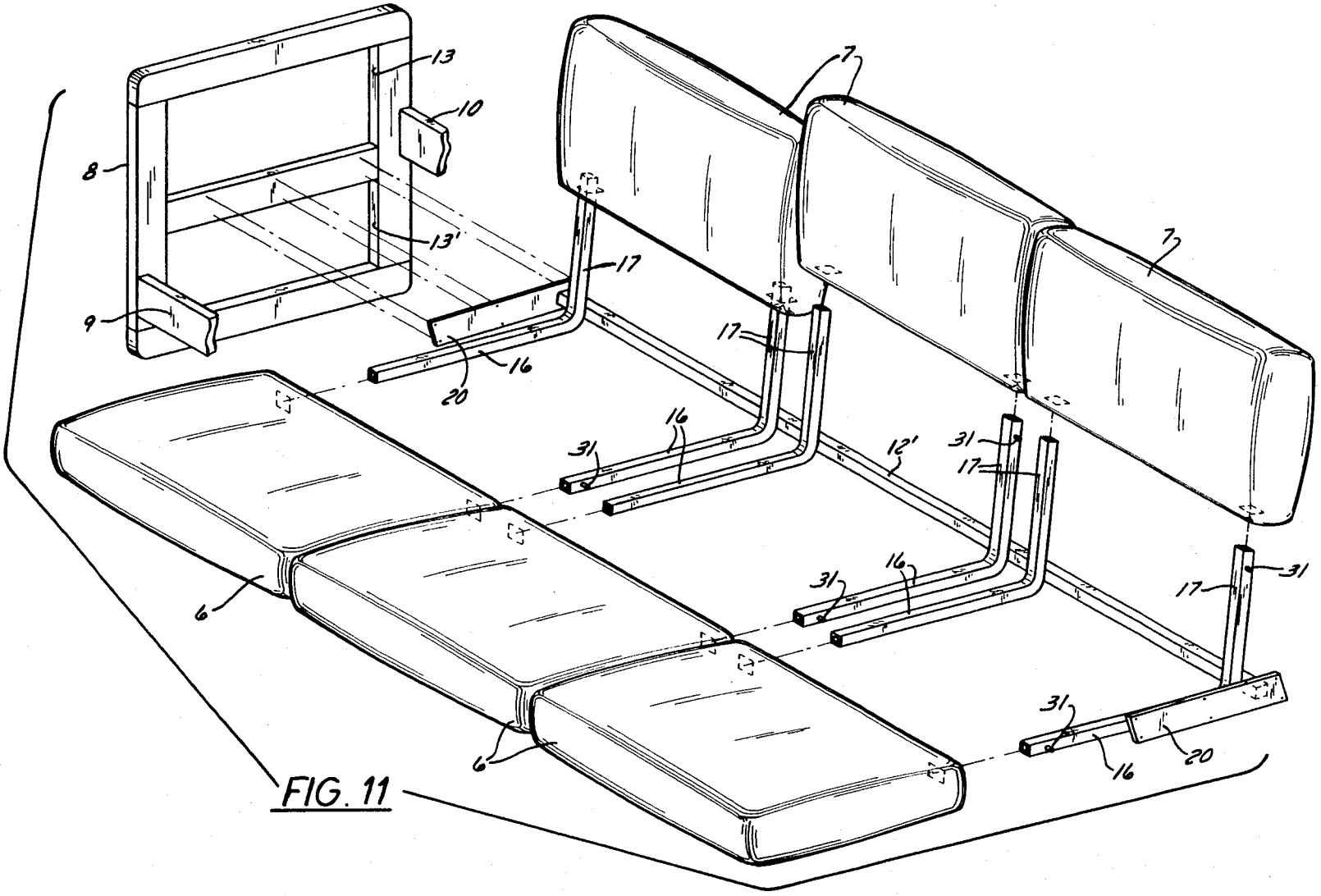
FIG. 11 is a disassembled perspective view of a modified embodiment of the invention in the form of a multiple seat unit.

The modified embodiment of the invention illustrated in FIG. 11 comprises a multiple-seat unit in the nature of a sofa, having three seat cushions 6 that are supported side-by-side and three similarly arranged back cushions 7. Each cushion 6, 7 is again supported by like legs 16, 16 or 17, 17 of a pair of L-shaped members 14. Six L-shaped members are needed, all secured to a single beam 12' at intervals along its length. Because of the length of the beam 12', which is supported only at its ends by side members 8 that are spaced apart by the distance across three seats, the beam may be subjected to substantial bending force in addition to high torsion force, and therefore it is made of rectangular-section tubing.

From the foregoing description taken with the accompanying drawings it will be apparent that this invention provides a very sturdy seating unit having reversible seat and back cushions which are normally locked in their normal positions and present no readily perceptible indication that they are removable from the supporting frame of the unit, but which can be quickly and easily removed by an authorized person with the use of a special but very inexpensive tool. It will also be apparent that the principles of the invention can be embodied both in chairs and in multiple-seat units, that all such seating units can be comfortable, attractive and relatively inexpensive, and that the cushion covers of such seating units do not lend themselves to abuse as hiding places for nuisance articles.

What is claimed as the invention is:

1. A seating unit comprising opposite upright side members that are rigidly connected in laterally spaced relation to one another, a seat cushion having a rear face, and a back cushion having a bottom face, each of said cushions having a substantially rigid internal frame, said seating unit being characterized by:

A. a laterally extending beam having opposite ends adjacent to the respective side members;

B. a plate-like connecting member rigidly secured to each end of the beam and projecting in a direction normal to the length of the beam, said connecting members being secured to their respectively adjacent side members at locations that are spaced from the beam to support the beam and resist rotation of it;

C. a pair of rigid substantially L-shaped members, each having (1) a forwardly projecting leg for the seat cushion, (2) an upwardly projecting leg for the back cushion, and (3) a rigid connection to the beam near the junction of its said legs whereby the L-shaped member is supported in inwardly spaced relation to the side members and with its legs spaced from and parallel to like legs of the other L-shaped member; and D. said internal frame of each cushion defining a pair of parallel bores which open to said face of the cushion and in which its legs of the L-shaped members are lengthwise slidably receivable.

2. The seating unit of claim 1, further characterized by:

E. a pair of detent devices for each cushion, one for each of said bores in the cushion, substantially simultaneously engaged by sliding the cushion fully onto its legs of the L-shaped members and whereby the cushion is releasably confined against displacement along its legs in the direction away from said beam, each said detent device comprising (1) a detent element on one of said legs and (2) a cooperating detent element on the internal frame of the cushion.

3. The seating unit of claim 2 wherein each of said detent devices positively but releasably locks the cushion against displacement away from said beam, each said detent device being further characterized by:

(a) one of said detent elements being movable in opposite directions parallel to the length of said beam and being biased in one of those directions for urging an abutment on it into engagement with a cooperating abutment on the other detent element, and (b) said one of the detent elements having a camming surface thereon whereby it can be moved in the other of said opposite directions by engagement thereagainst of said other detent element during a final stage of movement of the cushion fully onto its legs and by engagement thereagainst of a slender tool pushed lengthwise into the bore along the leg.

4. The seating unit of claim 3, further characterized by:

(1) each said detent device being located at a substantial distance along its bore from said face of its cushion, and (2) each bore having a widened portion at one side thereof, extending along its length from its detent device to said surface, in which said slender tool is receivable.

5. A seating unit comprising opposite upright side members that are rigidly connected in laterally spaced relation to one another, a seat cushion having a rear face, and a back cushion having a bottom face, each of said cushions having a substantially rigid internal frame, said seating unit being characterized by:

A. a pair of rigid substantially L-shaped members, each having (1) a forwardly projecting leg for the seat cushion and (2) an upwardly projecting leg for the back cushion;

B. a laterally extending beam having each of its ends rigidly connected to one of said side members, said beam having a rigid connection to each of said L-shaped members near the junction of its legs and supporting the L-shaped members in inwardly spaced relation to the side members and with like legs of the L-shaped members parallel to one another;

C. said internal frame of each cushion defining a pair of parallel bores which open to said face of the cushion and in which its legs of the L-shaped members are lengthwise slidably receivable; and D. a pair of detent devices for each cushion that are substantially simultaneously engaged by sliding the cushion fully onto its legs of said L-shaped members and whereby the cushion is releasably confined against displacement along its legs in the direction away from said beam, each said detent device comprising (1) a detent element on one of said legs and (2) a cooperating detent element on the internal frame of the cushion, (a) one of said detent elements being movable in opposite directions parallel to the length of said beam and being biased in one of those directions for urging an abutment on it into engagement with a cooperating abutment on the other detent element, and (b) said one of the detent elements having a camming surface thereon whereby it can be moved in the other of said opposite directions by engagement thereagainst of said other detent element during a final stage of movement of the cushion fully onto its legs and by engagement thereagainst of a slender tool pushed lengthwise into the bore along the leg.

6. A seating unit comprising opposite upright side members that are rigidly connected in laterally spaced relation to one another, a seat cushion having a rear face, and a back cushion having a bottom face, each of said cushions having a substantially rigid internal frame, said seating unit being characterized by:

A. a beam extending laterally between said side members and having each of its ends rigidly connected to said side members;

B. a pair of substantially rigid rod-like seat cushion legs having a cantilevered rigid securement to said beam and projecting forwardly therefrom in inwardly spaced relationship to said side members and parallel to one another to be lengthwise slidably receivable in bores in the internal frame of the seat cushion that open to its rear face and extend inwardly therefrom;

C. a pair of substantially rigid rod-like back cushion legs having a cantilevered rigid securement to said beam and projecting upwardly therefrom in inwardly spaced relationship to said side members and parallel to one another to be lengthwise slidably receivable in bores in the internal frame of the back cushion that opens to its bottom face and extend inwardly therefrom;

D. a pair of detent devices for each of said cushions, each said detent device comprising (1) a detent element on one of said legs and (2) a cooperating detent element on the internal frame of the cushion, each said detent device being arranged to be engaged by movement of the cushion fully onto its legs and, when engaged, to resist withdrawal of the cushion along the legs in the direction away from the beam, (a) one of said detent elements comprising a relatively stationary abutment, (b) the other of said detent elements being movable in opposite directions substantially parallel to the length of said beam and being biased in one of those directions for engagement of an abutment thereon with said relatively stationary abutment whereby the cushion is positively but releasably locked against sliding along its legs in the direction away from said beam, and (c) said other detent element having a camming surface extending obliquely outwardly in the bore and engageable by a long, slender tool inserted into the bore to effect disengagement of said abutments.

* * * * *